US005638891A

United States Patent [19]

Fukase et al.

[11] Patent Number: 5,638,891

[45] Date of Patent: Jun. 17, 1997

[54] CASTING ROLL

[75] Inventors: Hisahiko Fukase, Tokyo; Heiji Kato, Yokosuka; Tuyoshi Seki, Yokosuka; Kunio Matui, Yokosuka, all of Japan; Lloyd Walter Townsend, Wollongong, Australia

[73] Assignees: Ishikawajima-Harima Heavy Industries Company Limited, Tokyo, Japan; BHP Steel (JLA) Pty. Ltd., Melbourne, Australia

[21] Appl. No.: 560,925

[22] Filed: Nov. 20, 1995

[30] Foreign Application Priority Data

Jan. 13, 1995 [AU] Australia ..... PN0536

[51] Int. Cl.[6] ..... B22D 11/12

[52] U.S. Cl. ..... 164/448; 164/428; 164/442; 164/443

[58] Field of Search ..... 164/480, 448, 164/429, 479, 428, 442, 443; 492/46

[56] References Cited

U.S. PATENT DOCUMENTS

| | | | |
|---|---|---|---|
| 4,086,957 | 5/1978 | Schrewe et al. | 164/448 |
| 4,442,883 | 4/1984 | Yamakami et al. | 164/448 |
| 4,944,342 | 7/1990 | Lauener | 164/428 |
| 5,152,333 | 10/1992 | Barbe et al. | 492/46 |
| 5,209,283 | 5/1993 | Miltzow et al. | 164/448 |
| 5,469,909 | 11/1995 | Sasaki et al. | 164/448 |

FOREIGN PATENT DOCUMENTS

| | | | |
|---|---|---|---|
| 3819391 | 6/1987 | Germany | 492/46 |
| 63-32541 | 6/1988 | Japan | 492/46 |
| 4-253551 | 9/1992 | Japan . | |
| 2121919 | 1/1984 | United Kingdom | 492/46 |

*Primary Examiner*—Joseph J. Hail, III
*Assistant Examiner*—I.-H. Lin
*Attorney, Agent, or Firm*—Nikaido Marmelstein Murray & Oram LLP

[57] ABSTRACT

A casting roll (11) on which to cast molten metal comprises central shaft (12), an outer circumferential wall (14) fitted over cylindrical mandrel (15) and roll end walls (16). Longitudinal wall (14) is cooled by water passed through longitudinal passages (22) in that wall. The cooling water is passed to and from passages (22) through passages (23) in the central shaft, radial passages (24) in the end walls (16) and transition passages (25) interconnecting the radial passages with the longitudinal passages. In order to promote cooling of the end corners (31) of the roll, transition passages (25) extend in smoothly curved bends into regions of the roll disposed both radially and longitudinally outwardly from the intersection directions of the longitudinal passages (22) and radial passages (24) so as to provide for water flow close to the roll comers (31) without formation of stagnation pockets.

7 Claims, 2 Drawing Sheets

CASTING ROLL

TECHNICAL FIELD

This invention relates to casting rolls for the casting of metal strip. Such casting rolls may be used in a twin roll caster, although single roll casters are also known.

In a twin roll caster molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein the refer to the general region at which the rolls are closest together. The molten metal may be poured from a ladle into a smaller vessel from which it flows through a metal delivery nozzle located above the nip so as to direct it into the nip between the rolls, so forming a casting pool of molten metal supported on the casting surfaces of the rolls immediately above the nip. This casting pool may be confined between side plates or dams held in sliding engagement with the ends of the rolls.

The casting surfaces of the casting rolls are generally provided by outer circumferential walls provided with longitudinal cooling water passages to and from which water is delivered through generally radial passages in the end walls of the rolls. When casting ferrous metals the rolls must support molten metal at very high temperatures of the order of 1640° C. and their peripheral surfaces must be maintained at a closely uniform temperature throughout in order to achieve uniform solidification of the metal and to avoid localised overheating of the roll surface.

It has been found that efficient cooling of the outer end corners of the rolls presents a particular problem. It is known to provide circumferential notches at the outer corners of the rolls to receive the side dam plates with a sliding fit. This arrangement enables efficient cooling of the roll ends since the casting pool terminates at a position disposed inwardly from the ends of the circumferential wall of the roll and the cooling water passages pass directly across this region of the wall, but this arrangement can only be used with relatively thick circumferential walls. For more efficient cooling it is desirable to have a thinner circumferential wall and to locate the cooling passages closer to the peripheral surface of that wall. This precludes notching of the roll ends and the side dam plates must then engage the outer ends of the circumferential wall so that the casting pool extends through to the roll ends. The water flow passages in the circumferential wall of the roll do not traverse this region and localised heating of the outer corners of the roll becomes a severe problem. The present invention addresses this problem and enables effective cooling of these regions of the roll.

DISCLOSURE OF THE INVENTION

According to the invention there is provided a casting roll on which to cast molten metal comprising:

central shaft means for mounting the roll for rotation about a central axis;

a circumferential wall disposed about the central axis;

end walls extending between the ends of the circumferential wall and the shaft means; and cooling water passage means for flow of cooling water along the circumferential wall of the roll to cool its outer peripheral surface, said cooling water passage means comprising interconnected radial passages in the end walls and longitudinal passages in the circumferential wall;

wherein the radial passages and longitudinal passages are interconnected by transition passages which extend outwardly beyond the radially outward extremities of the longitudinal passages whereby to direct cooling water closer to the end corners of the roll than to the remainder of the outer peripheral surface of the circumferential wall of the roll and wherein the outer parts of the transition passages adjacent the end corners of the roll are shaped as smooth-walled ducts such as to maintain continuous flow of water throughout the ducts without stagnation.

Preferably said outer parts of transition passages are shaped as smoothly curved bends to constrain the continuous flow of water therethrough such as to avoid formation of stagnation pockets.

Preferably, the transition passages extend from the longitudinal passages longitudinally outwardly beyond the radial passages in the end walls of the roll.

More specifically, the transition passages may extend in smoothly curved bends extending into a region of the roll disposed both radially and longitudinally outwardly from the intersecting directions of the longitudinal and radial passages.

The radial passages may comprise a series of circumferentially spaced individual passages in each end wall of the roll.

The transition passages may comprise a single annular passage at each end of the roll interconnecting the series of radial passages in the end wall at that end of the roll with the longitudinal passages in the circumferential wall. In that case the outer walls of said ducts may be defined by annular grooves in the inner periphery of the circumferential wall.

The transition passages may be constricted at their regions closest to the outer corners of the roll so as in use to produce an increased water flow velocity at these regions compared with the flow velocity through the radial passages. More specifically, such passages are constricted thereby to promote substantially uniform cooling across the whole roll surface.

BRIEF DESCRIPTION OF THE DRAWINGS

In order that the invention may be more fully explained one particular embodiment will be described in some detail with reference to the accompanying drawings in which.

Figure 1:
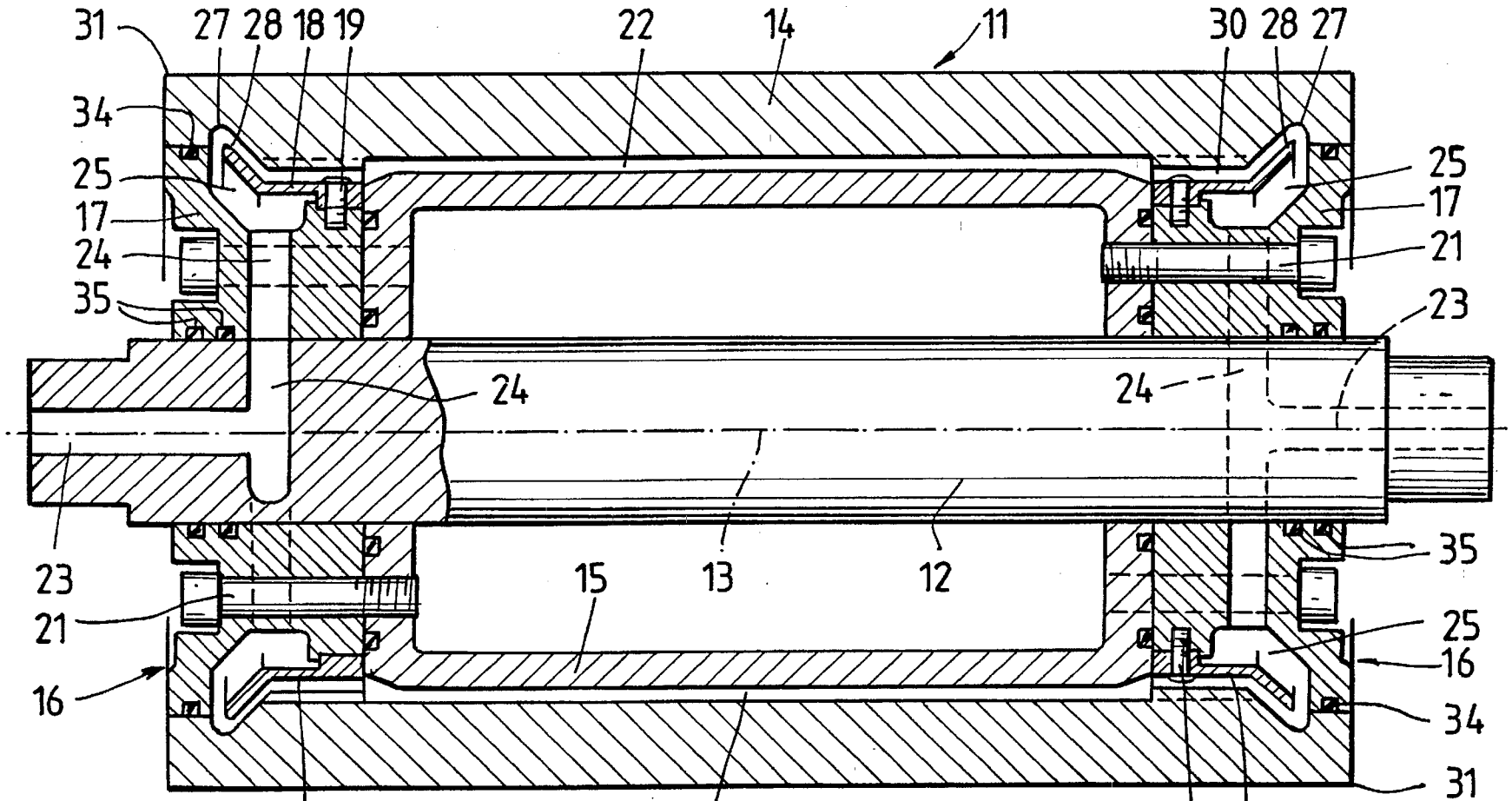
FIG. 1 is a longitudinal cross-section through a casting roll constructed in accordance with the invention.
Figure 2:
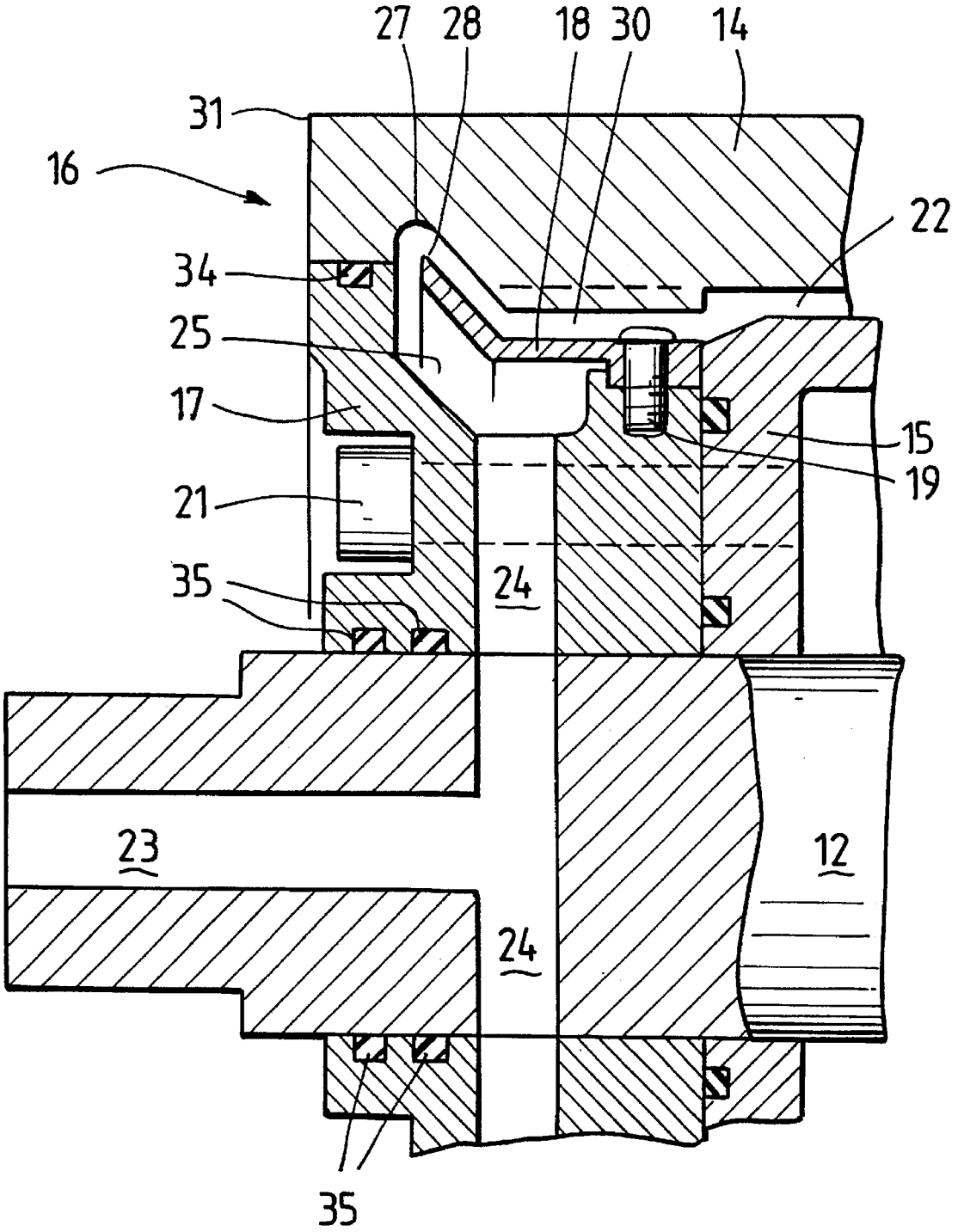
FIG. 2 illustrates the construction of the roll adjacent its outer end corners.

The illustrated roll comprises a central shaft 12 by which the roll can be mounted for rotation about a central roll axis 13. Roll 11 further comprises a circumferential wall in the form of a cylindrical copper sleeve 14 which fits over a generally cylindrical mandrel 15 and roll end walls 16.

BEST MODE OF CARRYING OUT THE INVENTION

Each end wall 16 is formed by a main annular member 17 and a ring member 18 which is fastened to member 17 by circumferentially spaced fastening screws 19. These composite end walls are fastened to the ends of the mandrel 15 by longitudinally extending axially spaced end clamping studs 21.

The outer periphery of mandrel 15 is formed with longitudinally extending circumferentially spaced channels which are closed by the roll sleeve 14 to form water flow passages 22 spaced circumferentially around the inner periphery of the sleeve. The edges of the some of the water flow channels of the mandrel are extended outwardly to fit into grooves in the inner periphery of sleeve 14 so as to key the sleeve to the mandrel.

Water is passed to and from the roll cooling water flow passages 22 via flow passages 23 formed in central shaft 12, radial passages 24 formed in the end wall components 17 and transition passages 25 which interconnect the radial end wall passages 24 and the longitudinal passages 22. More particularly, the water flows into the roll through one end of the shaft, then outwardly through the passages in the end wall at that end of the shaft to the passages 22. It then flows in one direction along the passages 22 to the other end of the roll where it flows inwardly through the radial passages in the respective end wall to exit through the passage in the other end of the shaft.

Transition passages 25 are formed by the shaping of the end wall components 17, 18 and the interior peripheral surface of sleeve 14. The outer peripheral surface of end wall ring 18 is formed with a series of circumferentially spaced longitudinal channels 30 which register with the channels of flow passages 22 and which therefore serve as continuations of those passages. Some of the rims of the channels 30 may be raised to engage with the slots in the interior surface of sleeve 14 so as to key the end walls to the sleeve. A pair of annular grooves 27 are formed in the inner periphery of sleeve 14 one adjacent each end of the sleeve so as to register with the outer rims 28 of the end wall rings 18. Each transition passage 25 is thus defined by an annular gap between the end wall ring 18 and the end wall annular component 17 and one of the grooves 27 which forms a flow passage around the rim of the end wall ring 18 extending into the divided flow passages 30 and thence to the main water flow passages 22. In this way the transition flow passages extend in a curved bend outwardly toward the outer most corners 31 of the roll and this, together with the constriction of the transition passage in this region to increase the water velocity, enables dramatically improved cooling of the ends of the roll sleeve.

It is important that the transition passages extend outwardly into the sleeve beyond the radially outward extremities of the longitudinal passages 22 whereby to direct the cooling water closer to the end corners 31 of the roll than to the remainder of the outer peripheral surface of the roll. It will also be seen that those parts of the transition passages defined by grooves 27 are spaced longitudinally outwardly beyond the radial passages 24 in the end walls so as to brought into close proximity with the roll corners 31. With this arrangement the transition passages extend in smoothly curved bends into regions of the roll disposed both radially and longitudinally outwardly from the intersecting directions of the longitudinal and radial passages 22 and 24.

The outer parts of the transition passages adjacent the roll end corners 31 are shaped as smooth-walled ducts such as to maintain continuous flow of water throughout those ducts without stagnation. Specifically, the outer curved walls defined by the annular grooves 27 in sleeve 14 and the rims 28 of the end wall rings define ducts in the form of smoothly curved bends which constrain the flow so as to avoid formation of stagnation pockets. It has been found that the inner walls provided by rims 28 of the end wall rings 18 serve an important function in constricting the flow to avoid stagnation and cavitation which can dramatically reduce heat transfer and lead to poor cooling of the roll end corners.

The interfaces between the end walls and the sleeve may be sealed by O-ring seals 34 and the interface between the end walls and the shaft can be sealed by appropriate O-ring seals 35.

The illustrated casting roll may typically be of the order of 500 mm diameter and have an outer sleeve thickness of the order of 20–35 mm. The longitudinal flow passages may typically be of the order of 4 mm deep×20 mm wide and the transition passages may be formed so as to provide generally the same flow cross-section as the longitudinal passages. This cross-section is significantly constricted relative to the flow area provided by the radial passages 24 which may typically be of the order of 35 mm diameter to provide a water flow rate of 72 l/sec. The size of passages 24 could be reduced if a high pressure pump is used to maintain the water flow rate.

The illustrated roll construction has been advanced by way of example and it could be modified considerably. Further, the longitudinal passages may be formed within the sleeve rather than the mandrel and the centre shaft may be formed integrally with the mandrel. In addition, the manner in which the transition passages are formed on assembly of the roll could be varied. Moreover, although the invention has been developed to overcome a specific problem experienced in twin roll casters it could be applied to casting rolls to be used in single roll casters.

We claim:

1. A casting roll on which to cast molten metal comprising:

a central shaft for mounting the casting roll for rotation about a central axis;

a cylindrical sleeve, having an outer peripheral surface, disposed co-axially about the central axis and extending longitudinally along the central axis between two ends of the cylindrical sleeve;

a pair of end walls, each extending radially outwards from the central shaft to one of the two ends of the cylindrical sleeve; and cooling water passage means for flow of cooling water along the cylindrical sleeve to cool the outer peripheral surface thereof, said cooling water passage means comprising interconnected radial passages which are defined in each of the pair of end walls and longitudinal passages which extend along the cylindrical sleeve;

wherein the radial passages and the longitudinal passages are interconnected by transition passages which extend radially beyond the extremities of the longitudinal passages and longitudinally beyond the radial passages whereby cooling water is directed into end corner regions of the casting roll which are disposed radially and longitudinally outwardly from intersecting directions of the longitudinal passages and the radial passages, the transition passages having outer parts which are adjacent to end corners of the casting roll and are shaped as smooth-walled ducts to maintain continuous flow of water throughout the ducts without stagnation.

2. A casting roll as claimed in claim 1, wherein the transition passages extend in smoothly curved bends through the end corner regions of the casting roll.

3. A casting roll as claimed in claim 1, wherein the radial passages comprise a series of circumferentially spaced individual passages which are defined in each of the pair of end walls.

4. A casting roll as claimed in claim 3, wherein the transition passages comprise an annular passage at each of the two ends of the cylindrical sleeve which interconnects the series of circumferentially spaced individual passages with the longitudinal passages.

5. A casting roll as claimed in claim 4, wherein the smooth-walled ducts have outer walls which are defined by internal annular grooves in the cylindrical sleeve.

6. A casting roll as claimed in claim 1, wherein the transition passages are constricted at the end corner regions to produce an increased water flow velocity in the end corner regions compared with a flow velocity through the radial passages.

7. A casting roll as claimed in claim 1, wherein the central shaft defines water flow passages therein for flow of water to and from the radial passages, the transition passages and the longitudinal passages.

* * * * *